US008281721B2

(12) United States Patent
Aguirre Fernandez

(10) Patent No.: US 8,281,721 B2
(45) Date of Patent: Oct. 9, 2012

(54) DEVICE FOR UNLOADING AND PLACING RAILS IN A TRACK PARALLEL TO ANOTHER EXISTING TRACK

(75) Inventor: Jose Mª Aguirre Fernandez, Madrid (ES)

(73) Assignee: Tecsa Empresa Contstructora, S.A., Madrid (ES)

( * ) Notice: Subject to any disclaimer, the term of this patent is extended or adjusted under 35 U.S.C. 154(b) by 183 days.

(21) Appl. No.: 12/582,207

(22) Filed: Oct. 20, 2009

(65) Prior Publication Data

US 2010/0116166 A1 May 13, 2010

(30) Foreign Application Priority Data

Oct. 21, 2008 (ES) ..... 200802959

(51) Int. Cl.
*B65G 13/00* (2006.01)

(52) U.S. Cl. ..... 104/2

(58) Field of Classification Search ..... 104/2–5, 104/7.1, 7.2, 7.3; 37/104; 171/16
See application file for complete search history.

(56) References Cited

U.S. PATENT DOCUMENTS 5,222,435 A * 6/1993 Theurer et al. ..... 104/2
5,520,497 A * 5/1996 Hertelendi et al. ..... 414/529
5,630,365 A * 5/1997 Hertelendi ..... 104/5
5,762,464 A * 6/1998 Hertelendi ..... 414/486
6,375,402 B1 * 4/2002 Hertelendi et al. ..... 414/373
6,981,452 B2 * 1/2006 Herzog et al. ..... 104/2

FOREIGN PATENT DOCUMENTS

DE 29501077 U1 3/1995
EP 0699802 A2 6/1996
EP 1386816 A1 2/2004
ES 2122746 T3 12/1998
FR 2399346 A1 2/1979

OTHER PUBLICATIONS

Spanish Search report for application No. ES200802859, Oct. 21, 2008.

* cited by examiner

*Primary Examiner* — S. Joseph Morano
*Assistant Examiner* — R. J. McCarry, Jr.
(74) *Attorney, Agent, or Firm* — Brown & Michaels, PC

(57) ABSTRACT

The invention relates to a device for unloading and placing rails in a track parallel to another existing track, which is assembled in the rear of the rail carrier train (Tc), which runs on the existing main track (Vd), coupled in a series of auxiliary wagons (V1, V2, V3), and formed by a series of metal structures (P1, . . . , P9) fixed in said auxiliary wagons added in the rear of the rail carrier train, which determine several fixed guiding points longitudinally distributed in a suitable manner along these auxiliary wagons, both in the transverse and in the vertical direction, in a smooth transition and according to the standards in relation to the radii and buckling of the rail, from its transport position on the rail carrier (Tc) to its definitive position on the bearing plate of the crossties previously positioned in an also definitive place on the subgrade of the parallel track (Vp).

4 Claims, 7 Drawing Sheets

DEVICE FOR UNLOADING AND PLACING RAILS IN A TRACK PARALLEL TO ANOTHER EXISTING TRACK

OBJECT OF THE INVENTION

The present invention relates to a device for unloading long rails in a parallel track, allowing directly unloading and positioning the rails on the actual bearing plate of the crosstie, in their definitive position.

BACKGROUND OF THE INVENTION

Currently, in those circumstances in which two railway tracks run parallel, the rails are transported in a rail carrier train running over the already assembled main track and are laterally unloaded directly onto the ballast bed, leaving a width between both rails greater than the width of the crossties. Thus, once the crossties are placed in their definitive position, it is necessary to later assemble the rail thereon, using rail positioners.

DESCRIPTION OF THE INVENTION

The device of the invention is aimed at directly unloading the rails of the parallel track from the rail carrier train running on the existing main track, successive rails being fishplated in the rail carrier train. The rails, from the rear of the rail carrier train, are lowered and moved laterally from the train to the parallel track, in a continuous manner as the train moves forward. It is necessary to indicate that the first 2 rails are anchored to a fixed point, and it is the train which moves at a uniform slow speed.

This device is coupled in a series of auxiliary wagons located in the rear of the rail carrier train, and is formed by a series of metal structures fixed in said auxiliary wagons, which determine several fixed guiding points for the rails, which are longitudinally distributed in a suitable manner along these auxiliary wagons, so that the rails are gradually transversely and vertically positioned from their transport position on the rail carrier to their definitive position on the bearing plate of the crossties previously positioned in an also definitive place on the subgrade of the parallel track.

The metal structures assembled in the auxiliary wagons are formed by a beam which is transverse to the forward movement and unloading direction, on which respective windows are fixed, which windows are internally provided with rollers through which the two rails pass guided. The first beam of the first auxiliary wagon located at the rear of the rail carrier train has its windows centered in the axis of the rail carrier and in a vertical direction above the wagon, and after that, in the following transverse beams or profiles, these windows are placed transversely moved towards the lateral subgrade where the parallel track is to be assembled, the distance being gradually greater in each profile. From the central beams of these auxiliary wagons and to those located in the rear of the last auxiliary wagon, both windows are located outside the wagon, on a beam like a lateral cantilever, located perpendicularly to the wagon and therefore to the forward movement of the rail carrier, fixed at one end to the side of the wagon and at the opposite end supported on the ground by means of wheels, which are supported outside the parallel track, said supports located in increasingly lower planes as the beam is placed towards the rear of the train.

In order to be able to compensate the possible height difference between the main track, over which the rail carrier train runs, and the parallel track, the rails of which are to be laid, the supports of the beams like a cantilever which are laterally fixed supported on the side of the wagon and on wheels located outside the track have means allowing their height regulation.

It has likewise been provided that the two windows with rollers of the last rear profile are vertically located on the same axis of the two rails in their definitive position, i.e., in the same axis of the bearing plates of the crossties. These windows are fixed to a telescopic structure, so that this assembly can move slightly on the cantilever-beam, for the purpose of maintaining the desired width by transversely regulating the position by means of a hydraulic mechanism which is fixed to a support on the cantilever beam itself.

For the handling, assembly, fixing to the wagon and placement in the forward movement position of the cantilevers, there are as many other metal structures like a foldable jib which are placed in a folded position during the movement of the rail carrier train, and once the train is stabled in its work position, they are placed perpendicularly to the track center line and fixed in that position, thus allowing the quick and simple handling of the rail guiding window structures.

According to another feature of the invention, the guiding windows for the rails to be unloaded have two welded outlets, one directed in the forward movement direction and another one in the opposite direction, to allow unloading the rail by means of the structures themselves, both if the parallel track is at the left of the main track in the forward movement direction and at the right.

Therefore, the device of the invention allows the lateral unloading of the rails anchored to a fixed point directly onto the bearing plates of the crossties, previously positioned along the layout on a ballast bed. The transition of the rails from their transport position in the rail carrier train to their final position on the bearing plate of the crosstie is performed smoothly, both in the transverse direction and in the vertical direction, being calculated so that the rail is not subjected to radii or buckling greater than those allowed by the standards at any time.

This unloading system has the advantage that it prevents the pull of the rails both longitudinally and laterally, preventing any unnecessary wear or warp of the rail.

The system is flexible in that the supports of the guiding structures are prepared to adopt the unloading position both at the right and at the left of the rail carrier train in the forward movement direction.

DESCRIPTION OF THE DRAWINGS

To complement the description being made and for the purpose of facilitating the understanding of the features of the invention, a set of drawings is attached to the present specification in which the following has been depicted with an illustrative and non-limiting character.

PREFERRED EMBODIMENT OF THE INVENTION

This device is assembled in the rear of a rail carrier train (Tc) which is positioned in the already assembled main track (Vd), on which it runs, which is parallel to the track (Vp) on which the rails are to be assembled. The first two rails are initially anchored at fixed points, or to the ends of the two rails already placed in the parallel track (Vp) which is to be extended. Thus, the rail carrier train in its forward movement, at uniform speed, gradually laterally moves and lowers both rails from the rail carrier train (Tc) to their definitive position in the parallel track (Vp), directly onto the bearing plates of the crossties, which have been previously placed and positioned in their definitive location on a ballast bed, continuing the existing track or starting from the previously marked fixed points. Before the final end of the rails comes out of the rail carrier train completely, the latter stops running and the next two rails to be unloaded are fishplated to these ends. The new rails (2) are thus gradually laid and positioned in their definitive place on the bearing plates after the previous ones, as the rail carrier train moves forward.

Figure 1:
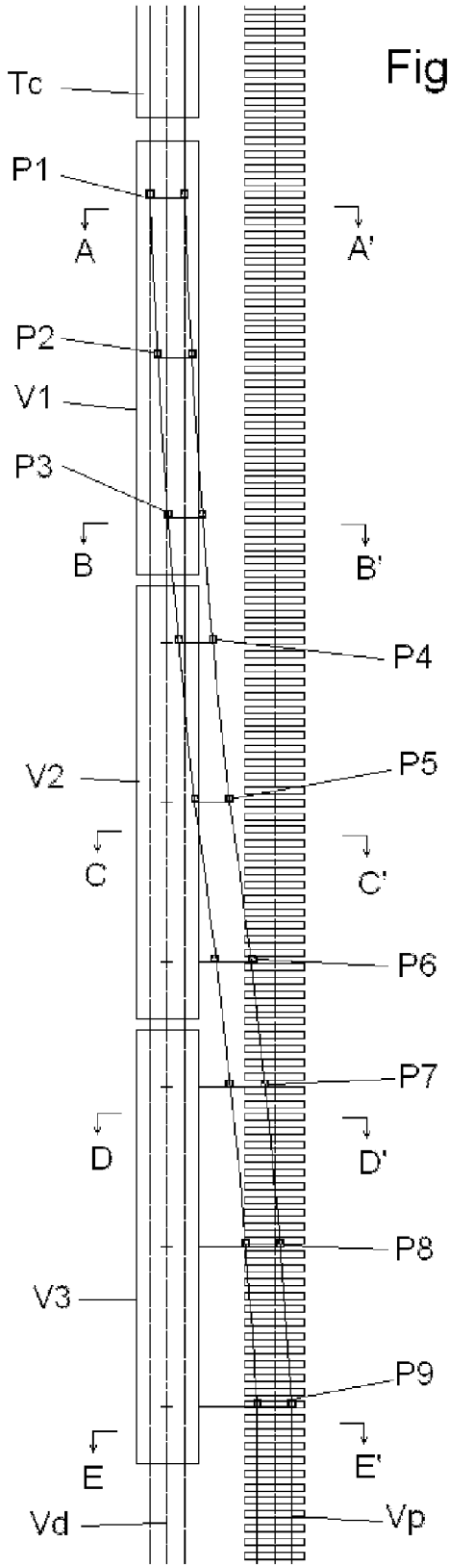
FIG. 1 shows a schematic plan view of an area of the tracks on which the device of the present invention is positioned.
Figure 2:
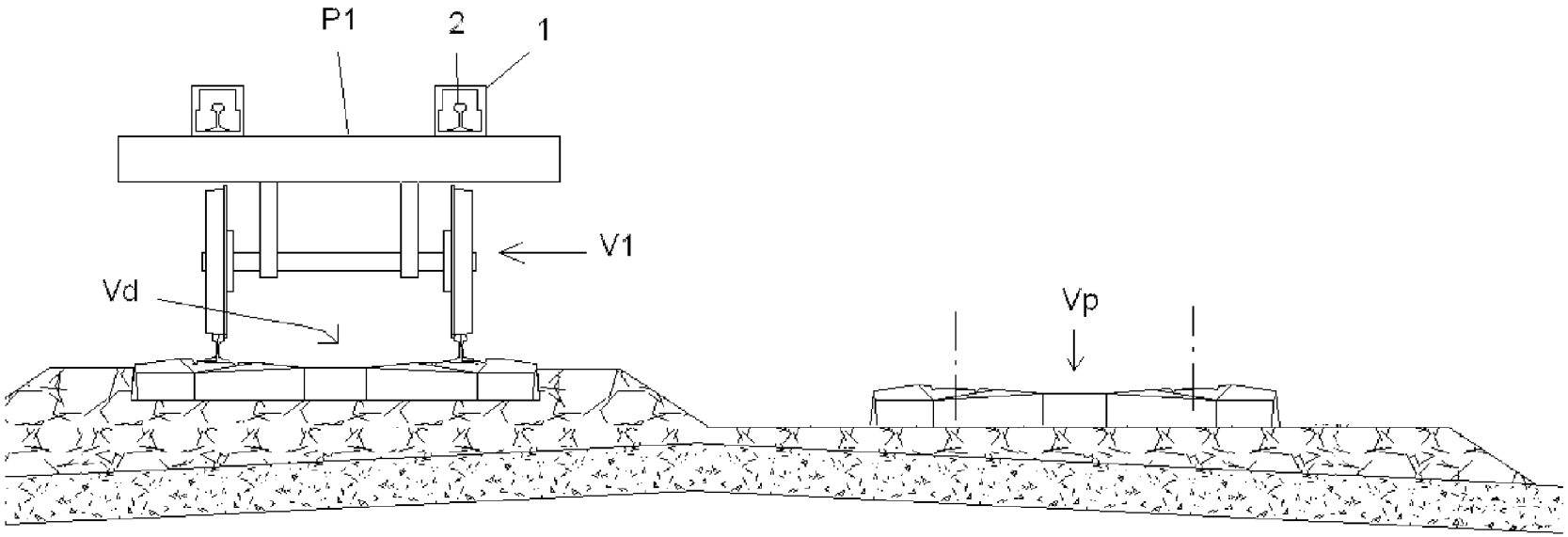
FIG. 2 shows elevational view through the section lines A-A' marked in FIG. 1, which respectively corresponds to the transverse beams or profiles referenced as P1 in said figure.

The device of the present invention is assembled in the rear of the rail carrier train (Tc), running on the main track, in which a series of MMQ type auxiliary wagons or the like have been coupled; the number of auxiliary wagons is normally three (V1, V2 and V3) as seen in FIG. 1. In any case, the length of these auxiliary wagons must be enough to allow performing, along such auxiliary wagons, the geometry transition of the rails which are being laid from their transport position on the rail carrier (Tc) to their definitive position on the bearing plate of the crossties previously positioned in also definitive place on the parallel subgrade (Vp) in relation to the main track. This transition is performed smoothly and is carried out both in the transverse direction and in the vertical direction, being calculated so that it is not subjected to radii or buckling greater than those allowed by international standards at any time.

Figure 3:
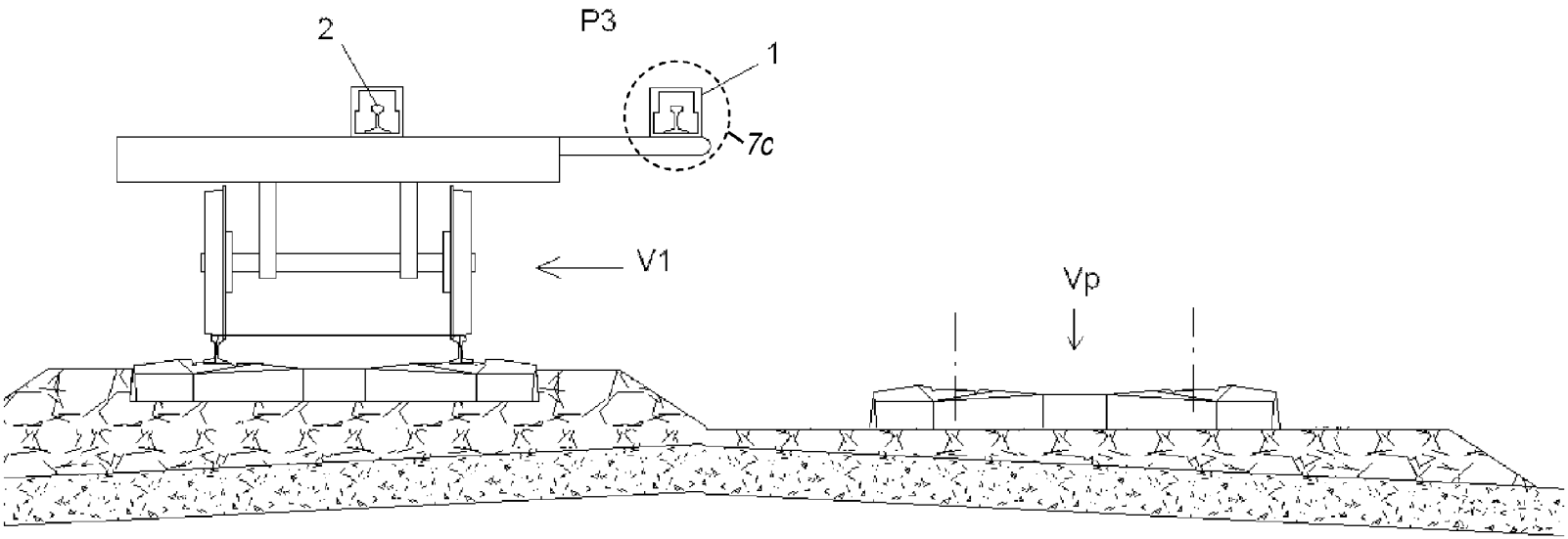
FIG. 3 shows an elevational view through the section lines B-B' marked in FIG. 1, which respectively corresponds to the transverse beams or profiles referenced as P3 in said figure.
Figure 4:
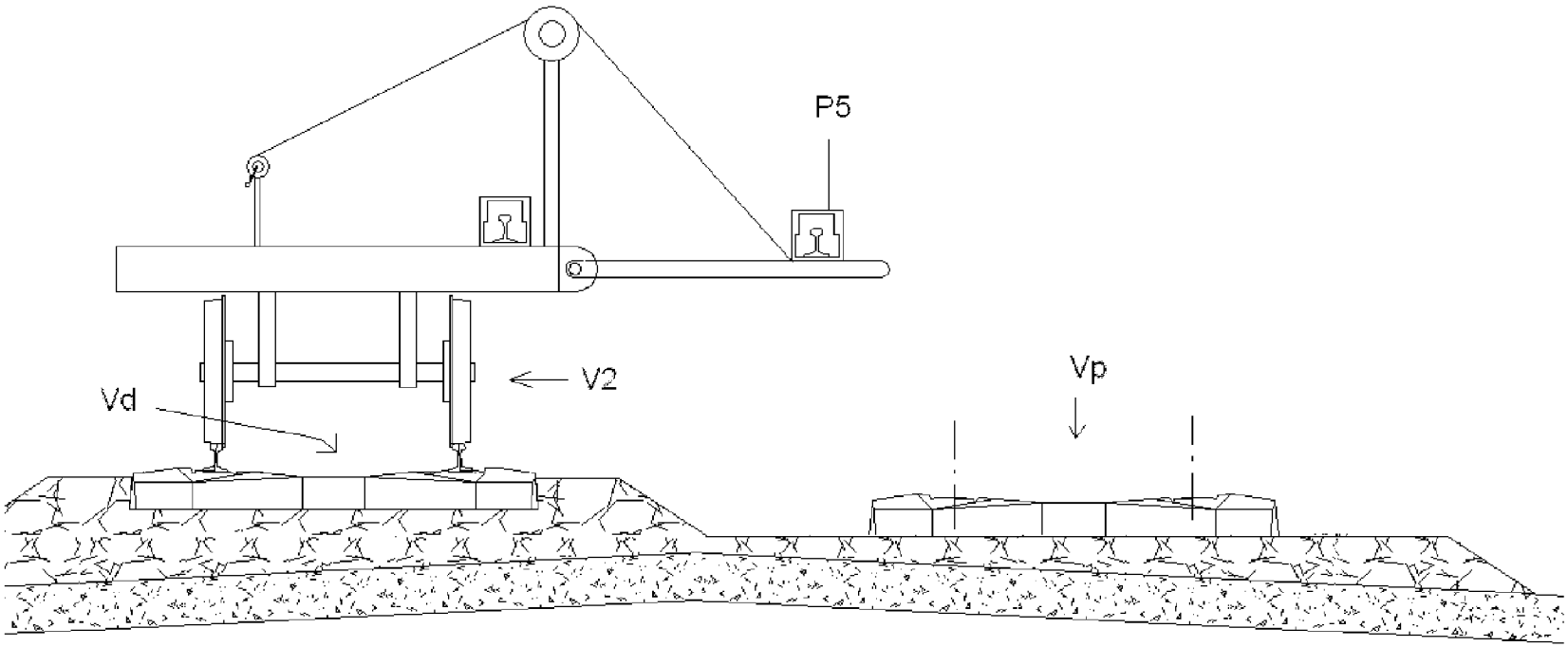
FIG. 4 shows an elevational view through the section lines C-C' marked in FIG. 1, which respectively corresponds to the transverse beams or profiles referenced as P5 in said figure.
Figure 5:
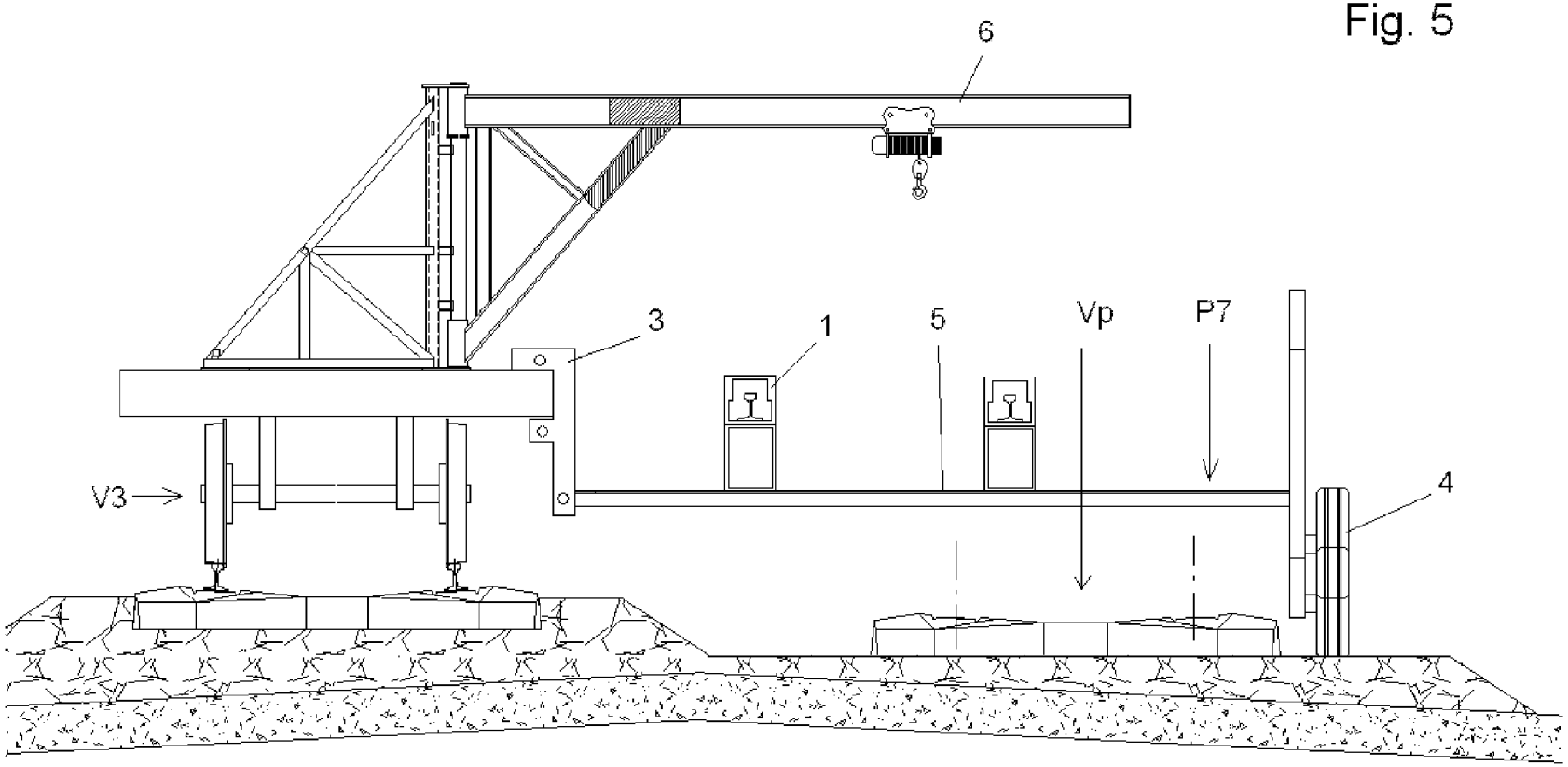
FIG. 5 shows an elevational view through the section lines D-D' marked in FIG. 1, which respectively corresponds to the transverse beams or profiles referenced as P7 in said figure.
Figure 6:
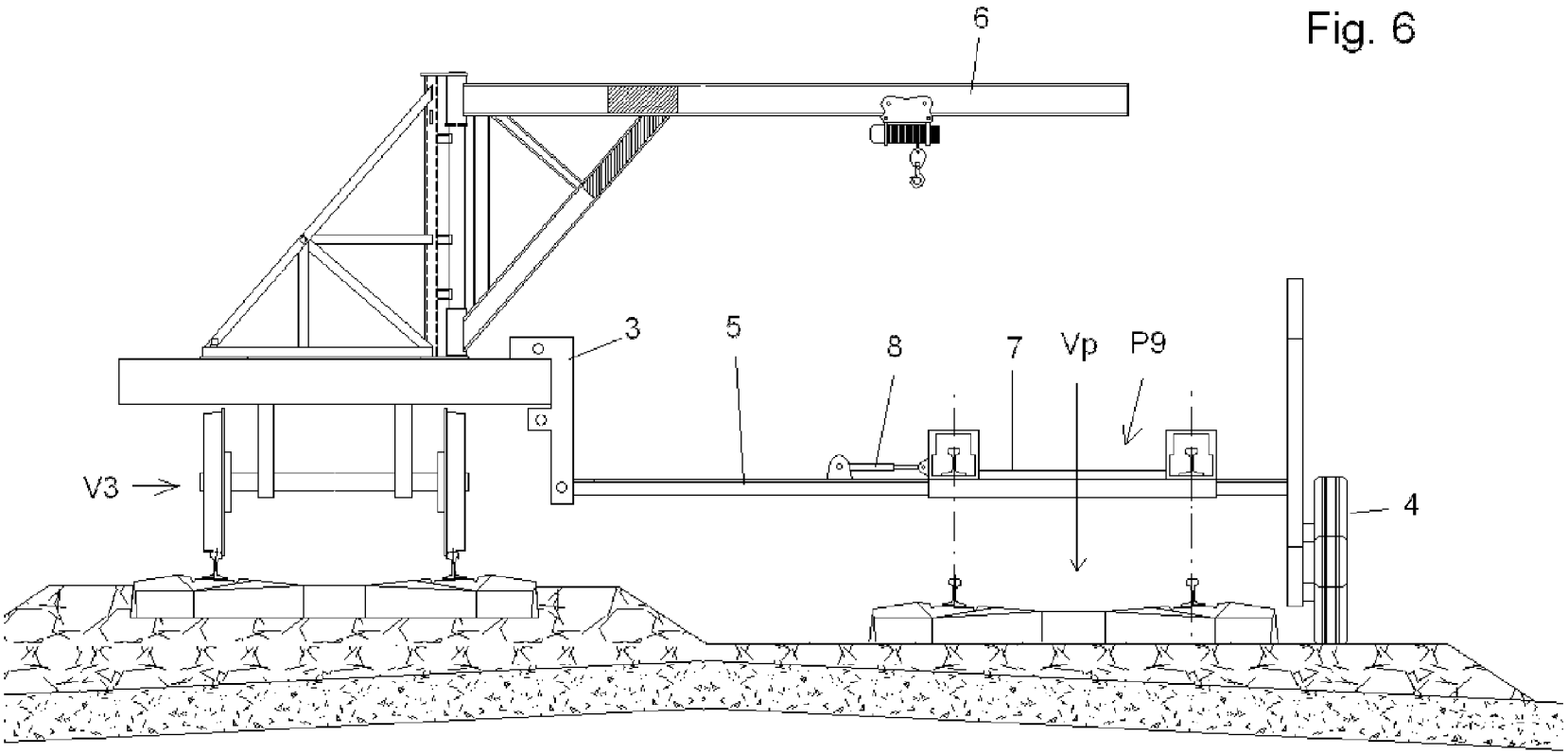
FIG. 6 shows an elevational view through the section lines E-E' marked in FIG. 1, which respectively corresponds to the transverse beams or profiles referenced as P9 in said figure.
Figure 7A:
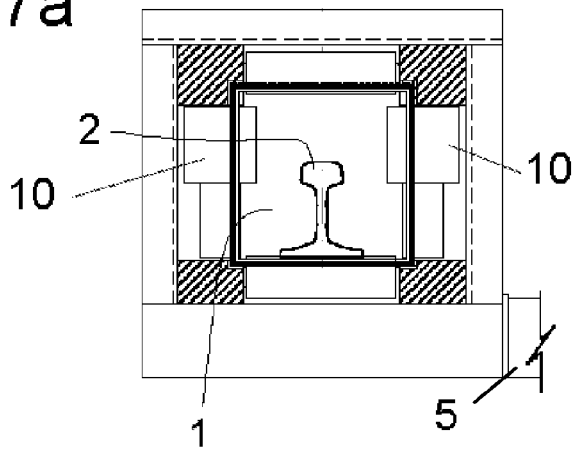
FIG. 7*a* shows a cut-through detail of a window, along cut lines 7*a*-7*a* in FIG. 7*c*.
Figure 7B:
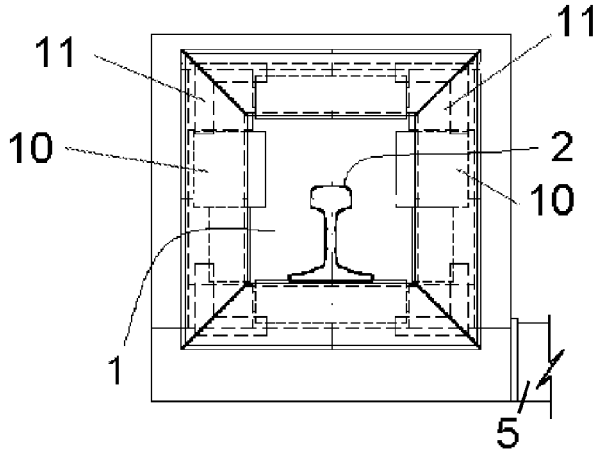
FIG. 7*b* shows a front view detail of a window, along view lines 7*b*-7*b* in FIG. 7*c*.
Figure 7C:
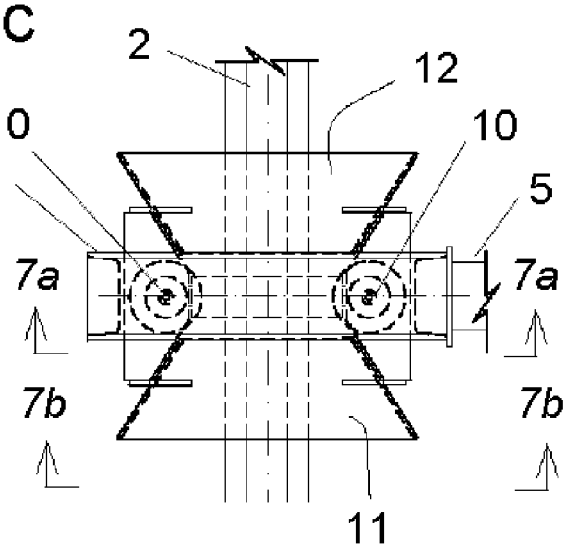
FIG. 7*c* shows a detail top view of a window, from dashed circle 7*c* in FIG. 3.

This guiding of the rail is carried out by means of metal structures fixed to the three wagons added in the rear of the rail carrier train. These structures are configured by a metal beam transverse to the forward movement and unloading direction, on which there are fixed two lateral metal windows (1). Detailed drawings of the windows (1), from the part of FIG. 3 within dotted circle 7*c*, can be found in FIGS. 7*a*-7*c*. The windows (1) have outlets, internally provided with rollers (10) which are also made of metal, the purpose of which is to force the two rails (2) to pass through their inside—thus forming the fixed points—guiding them such that the development of the rail both in the transverse and in the vertical direction is the one required. The inner rollers (10) allow the sliding of the two rails in the forward movement of the rail carrier train. These beams or profiles (P1 to P9) act as fixed guiding points, for which purpose they are longitudinally distributed in a suitable manner along the auxiliary wagons (V1, V2, V3).

These windows (1) have been designed with two welded outlets (11) and (12), one (12) directed in the forward movement direction and another one (11) in the opposite direction. This design allows unloading the rail by means of the structures themselves, the parallel track being both at the left of the main track in the forward movement direction and at the right. Likewise, the supports (3) to the wagons of all the metal guiding structures are prepared to change their position such that the unloading can be carried out both at the right and at the left of the rail carrier train in the forward movement direction.

Nine profiles distributed in three auxiliary wagons, each of which incorporates two windows (1) with rollers, are observed in the figures. The first profile (P1), located on the first of the three wagons (V1) in the position closest to the end of the rail carrier train has both windows centered in the axis of the rail carrier. In the vertical direction, the assembly is positioned immediately above the platform of the wagon (V1).

After that, in the following profiles (P2, . . . , P9), both windows (1) are placed transversely moved towards the lateral subgrade, i.e., towards the parallel track (Vp) which is to be assembled. The movement is gradual so that the distance is gradually greater in each profile, such that the rails (2) are gradually closer, smoothly and observing the international standards in relation to radii and buckling, to their final position on the bearing plates of the crossties. In these following initial profiles, the height remains constant as they are within the width of the wagon.

The first profiles (P1, P2, P3, P4 and P5) are permanently fixed to the wagons, although in order to always observe the running gauge, it is necessary for the outer window of the latter to be lowerable, either longitudinally or vertically. These latter outer windows are located at a lower height than the previous ones, such that the vertical transition also complies with regulations. This vertical height will decrease in the successive profiles for this purpose.

In the last profiles (P6, P7, P8 and P9), both windows are already outside the wagon. In order to allow this, the structure beam (5) has been designed in the form of a removable lateral cantilever, also located perpendicularly to the forward movement of the rail carrier. One end (3) is fixed by means of a bolt to a support structure implemented on the side of the wagon, whereas the other end is directly supported in the ground by means of wheels (4), such that the forward movement of the assembly maintaining the perpendicularity is possible. Both the lateral support of the wagon to which the cantilever is fixed and the support of the other end, on which it moves by means of wheels, have through boreholes, such that by means of bolts it is possible to slightly regulate the height at which the cantilever-beam is fixed. This is so in order to compensate the possible height difference between the main track, over which the rail carrier train runs—which can be in different leveling states—and the parallel track, the rails of which are to be laid.

To provide the beam with greater rigidity and allows its correct movement, the cantilever-assembly is secured by means of two tie rods anchored to the wagon. The windows are likewise fixed on the cantilever, but in a position increasingly closer to the definitive position of the rails both transversely and in height.

The two windows of the last profile (P9) are located vertically on the same axis of the two rails (2) in the definitive position thereof, i.e., in the same axis of the bearing plates of the crossties. Vertically, they are located close to the crossties.

To absorb possible variations between both tracks—the main track and the parallel track—, this last structure has been configured in a manner different from the previous ones. The two windows with rollers have been fixed to a telescopic structure (7), allowing this assembly to move slightly on the cantilever-beam as an axis. The desired width is thus maintained but the position is transversely regulated so that both windows are located on the vertical of the bearing plates at all times. The mechanism used to carry out this regulation is a hydraulic cylinder (8) fixed to a support on the cantilever beam itself.

For the handling of these rear cantilevers (P6, P7, P8 and P9), their assembly and fixing to the wagon and their placement in the forward movement position, since they have a considerable weight, as many other structures like a foldable jig (6) have been installed. These structures consist of a part fixed to the wagon, with rotating bushings on which it rotates through a cantilevered profiles serving as support for the lifting tackle rotates through a metal shaft. During the movements of the rail carrier train, the mobile part of the assembly, i.e., the support profile of the lifting tackle will be in a folded position (longitudinal to the forward movement direction). This is so in order to observe the railway gauge. Once the train is stabled in its work position, these profiles with lifting tackle, as a result of the rotation system, are located perpendicularly to the track center line and are fixed in that position, thus allowing the quick and simple handling of the rail guiding window structures.

The invention claimed is:

1. A device for unloading and placing rails from a rail carrier train on an existing main track onto crossties of a track parallel to the existing track, comprising:

a plurality of auxiliary wagons at a rear of a rail carrier train having a series of metal structures fixed to said auxiliary wagons, having fixed guiding points longitudinally distributed along the auxiliary wagons, each of the metal structures comprising:

a beam which is transverse to the a forward movement and unloading direction of the rail carrier train, and a pair of windows mounted to each beam, spaced apart a distance, each window comprising a pair of rollers internal to the windows, for guiding the rails transversely;

the windows on each of the series of metal structures being located on the beam as follows:

the windows of a first beam being transversely of centered on an axis of a first auxiliary wagon and in a vertical direction above the first auxiliary wagon, the windows on a plurality of following beams being placed at transverse distances from the axis towards the parallel track, the transverse distance being gradually greater on each beam; and at least one of the windows on each of a further plurality of beams being located outside the wagon, the beam forming a cantilever, located perpendicularly to the axis of the wagon and to the forward movement of the rail carrier, a first end of each of the further plurality of beams being fixed at one end to a side of the wagon and at the opposite end being supported on the ground by means of a support having at least one wheel located outside the parallel track said supports being located in increasingly lower planes towards the rear of the train, the supports being adjustable in height to compensate for a height difference between the main track, over which the rail carrier train runs, and the parallel track;

the windows on at least the beam closest to the rear of the train being located such that the rails passing through the windows are spaced apart to their final running gauge;

such that each of the rails passing through the windows is guided transversely and vertically in a smooth transition from its transport position on the rail carrier train to a position on crossties on the subgrade of the parallel track.

2. The device according to claim 1, in which:

the two windows on the last beam located in the rear of the last auxiliary wagon are mounted on a telescopic structure slideably supported by the beam; and a rearmost metal structure of the last auxiliary wagon further comprises a hydraulic mechanism having a first end fixed to a support on the cantilever beam and a second end fixed to the telescopic structure;

such that a transverse position of the two windows is regulated by the hydraulic mechanism sliding the telescopic structure along the beam to locate the windows vertically over bearing plates on the crossties of the parallel track.

3. The device according to claim 1, further comprising a foldable jib fixed to at least one auxiliary wagon, movable from a folded position during the movement of the rail carrier train, to a work position perpendicular to a center line of the main track.

4. The device according to claim 1, in which the windows further comprise two welded outlets, one directed in a forward movement direction and another one in an opposite direction, and the metal structures of the auxiliary wagons are configured to be placed at either side of the auxiliary wagon, to allow unloading the rail by means of the metal structures if the parallel track is at the left or at the right of the main track in a forward movement direction.

* * * * *

UNITED STATES PATENT AND TRADEMARK OFFICE

CERTIFICATE OF CORRECTION

PATENT NO. : 8,281,721 B2
APPLICATION NO. : 12/582207
DATED : October 9, 2012
INVENTOR(S) : Aguirre Fernandez It is certified that error appears in the above-identified patent and that said Letters Patent is hereby corrected as shown below:

Claim 1, (Column 5, line 37): Delete the word "the".

Signed and Sealed this
Fifteenth Day of January, 2013

David J. Kappos

David J. Kappos
*Director of the United States Patent and Trademark Office*